US005311911A

United States Patent [19]

Krausser et al.

[11] Patent Number: 5,311,911

[45] Date of Patent: May 17, 1994

[54] TUBE PLUG FOR CLOSING A DEFECTIVE HEAT EXCHANGER TUBE, METHOD FOR CLOSING A DEFECTIVE HEAT EXCHANGER TUBE AND METHOD FOR LOOSENING A TUBE PLUG

[75] Inventors: Peter Krausser, Fürth; Alexander Hümmeler, Röttenbach, both of Fed. Rep. of Germany

[73] Assignee: Siemens Aktiengesellschaft, Munich, Fed. Rep. of Germany

[21] Appl. No.: 885,075

[22] Filed: May 18, 1992

Related U.S. Application Data

[63] Continuation of Ser. No. 683,577, Apr. 10, 1991, abandoned, which is a continuation of Ser. No. 443,597, Nov. 29, 1989, abandoned.

[30] Foreign Application Priority Data

Nov. 29, 1988 [WO] PCT Int'l Appl. ..... PCT/DE88/00738

[51] Int. Cl.[5] ..... F16L 55/10

[52] U.S. Cl. ..... 138/89

[58] Field of Search ..... 138/89, 91, 93, 96 R, 138/97, 98, 109; 29/255, 426.4, 426.5; 228/191, 264; 376/451, 260, 203, 204

[56] References Cited

U.S. PATENT DOCUMENTS

| | | | |
|---|---|---|---|
| 4,170,247 | 10/1979 | Bates | 138/89 |
| 4,178,966 | 12/1979 | Savor et al. | 138/89 |
| 4,283,826 | 8/1981 | Miller | 29/426.4 X |
| 4,498,339 | 2/1985 | Diggins | 228/191 X |
| 4,502,511 | 3/1985 | Zafred | 138/89 |
| 4,513,786 | 4/1985 | Sodergren et al. . | |
| 4,734,972 | 4/1988 | Hawkins | 29/255 X |
| 4,751,944 | 6/1988 | Sinha et al. | 220/234 X |
| 4,829,660 | 5/1989 | Everett et al. | 29/426.4 X |

FOREIGN PATENT DOCUMENTS

| | | |
|---|---|---|
| 0122610 | 10/1984 | European Pat. Off. . |
| 0137984 | 4/1985 | European Pat. Off. . |
| 0142985 | 5/1985 | European Pat. Off. . |
| 0291003 | 11/1988 | European Pat. Off. . |
| 3713394 | 4/1986 | Fed. Rep. of Germany . |

*Primary Examiner*—Daniel P. Stodola
*Assistant Examiner*—John P. Darling
*Attorney, Agent, or Firm*—Herbert L. Lerner; Laurence A. Greenberg

[57] ABSTRACT

A tube plug for closing a defective heat exchanger tube includes a hollow conical portion having a closed free end and a hollow cylindrical portion merging fluidly with the hollow conical portion without a step. The hollow cylindrical portion has an outer surface with an outside diameter being smaller than the inside diameter of the heat exchanger tube to be closed. The outer surface of the hollow cylindrical portion has a roughened region to be expanded into sealing contact with the inner surface of the heat exchanger tube. The roughened region has a peak-to-valley height of substantially between 0.05 and 0.2 mm. A device is disposed in the hollow cylindrical portion and/or the hollow conical portion for positioning and locking a pulling tool. A method for loosening a tube plug firmly retained in a heat exchanger tube by melting the surface of the wall of the tube plug along a predetermined path with a welding tool, and a method for closing a defective heat exchanger tube by inserting a tube plug and expanding a cold-formed roughened region of the cylindrical portion from inside and forcing the roughened region into locking contact with the inner surface of the heat exchanger tube, are also provided.

16 Claims, 2 Drawing Sheets

Fig.1
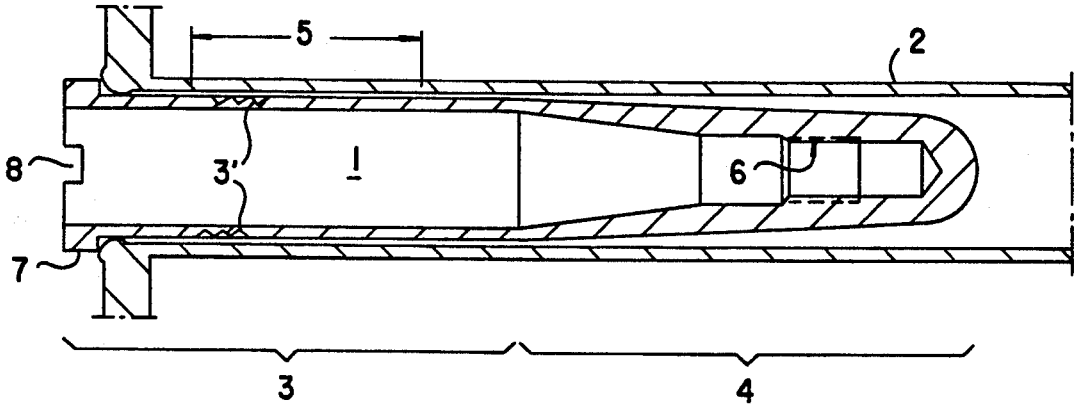
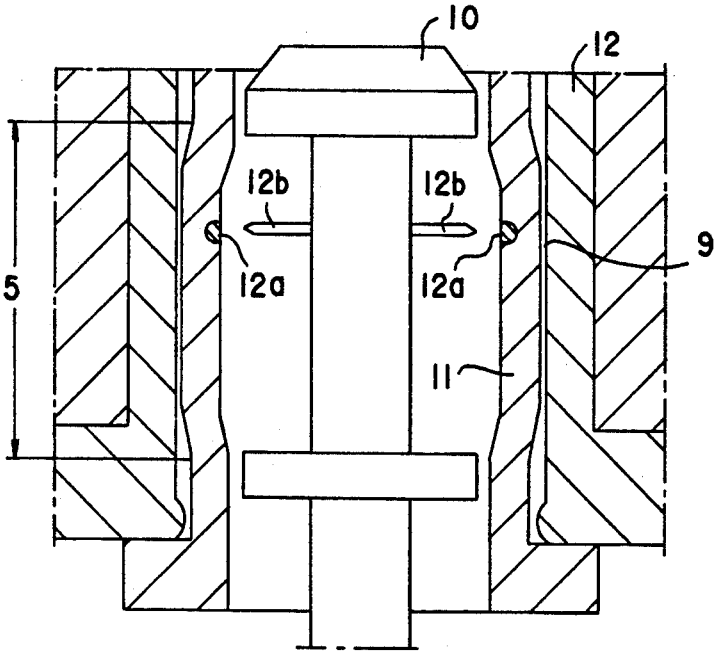
Fig.2
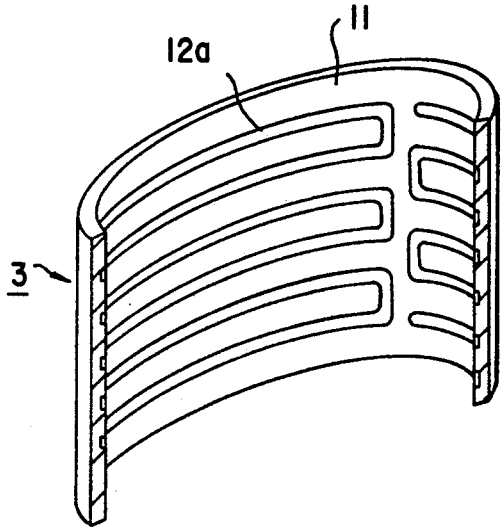
Fig.3

TUBE PLUG FOR CLOSING A DEFECTIVE HEAT EXCHANGER TUBE, METHOD FOR CLOSING A DEFECTIVE HEAT EXCHANGER TUBE AND METHOD FOR LOOSENING A TUBE PLUG

This application is a continuation of application Ser. No. 07/683,577, filed Apr. 10, 1991, now abandoned, which is a continuation of application Ser. No. 07/443,597, filed Nov. 29, 1989, now abandoned.

The invention relates to a tube plug for closing a defective heat exchanger tube, in which a hollow cylindrical portion merges with a hollow conical portion having a closed free end, the cylindrical portion has an outside diameter that is slightly smaller than the inside diameter of the heat exchanger tube to be closed, and the cylindrical portion is brought into sealing contact with the inner surface of the heat exchanger tube by expansion. The invention also relates to a method for closing a defective heat exchanger tube, and to a method for loosening a tube plug that is firmly held in a heat exchanger tube, in particular by expansion.

U.S. Pat. No. 4,513,786 discloses a tube plug of the type described above, which has a substantially constant outside diameter, with one portion of the plug having a slightly larger diameter in the vicinity of its open end, to assure an easy press fit in the tube. A strip of deformable material, which is formed of either gold, silver or pure iron, is applied to one portion of the outer surface of the plug. The tube plug is introduced into the tube end so that it closes it off flush. The portion of the tube plug provided with the deformable material is then expanded by means of a rolling tool, so that a tight connection with the tube is produced. The removal of such a tube plug is difficult and can be carried out only with the use of specialized gripping tools. Furthermore, corrosion-promoting deposits can collect in the unexpanded region between the tube plug and the heat exchanger tube. This destroys tube plug or the tube.

U.S. Pat. No. 4,502,511 discloses another tube plug, which is fixed in the heat exchanger tube by expansion using rollers. The tube plug has a substantially cylindrical shape. A flange is provided as a depth stop at the open end of the tube plug. In the region in which the tube plug is rolled firm, the outer wall of the tube plug has a radial indentation, in which an elastomer silicon material is applied. In that known tube plug, the danger of premature leaks exists. Furthermore, very strong retaining forces with respect to the tube cannot be brought to bear because of the thinner wall thickness in the region of the elastomeric material. The tube plug cannot be securely held by means of the expansion.

A tube plug is also known from U.S. Pat. No. 4,178,966, which has one conical portion and one cylindrical portion, and in which two coaxial bores are provided. A thread for screwing a pulling tool is provided in a third bore.

However, that tube plug is provided for welding into the tube plate of a heat exchanger, as a result of which there is thermal stress on that region. Moreover, removal of the plug is difficult.

It is accordingly an object of the invention to provide a tube plug for closing a defective heat exchanger tube, a method for closing a defective heat exchanger tube, and a method for loosening a tube plug, which overcome the hereinafore-mentioned disadvantages of the heretofore-known methods and devices of this general type. The plug is to have improved sealing action and greater retaining force as compared with the known tube plugs, and nevertheless should be easy to pull out and the method for loosening the plug should permit the tube plug to be pulled out with little exertion of force.

With the foregoing and other objects in view there is provided, in accordance with the invention, a tube plug for closing a defective heat exchanger tube, comprising a hollow conical portion having a closed free end, a hollow cylindrical portion merging fluidly with the hollow conical portion without a step, the hollow cylindrical portion having an outer surface with an outside diameter being slightly smaller than the inside diameter of the heat exchanger tube to be closed, the outer surface of the hollow cylindrical portion having a roughened region to be expanded into sealing contact with the inner surface of the heat exchanger tube, the roughened region having a peak-to-valley height of substantially between 0.05 and 0.2 mm, and means disposed in the cylindrical portion and/or in the conical portion for positioning, accepting or inserting and locking a pulling tool.

In this way, although cleaning of the heat exchanger tube prior to installation is unnecessary, easier pulling of the tube plug and increased retaining forces and sealing action are provided without producing any deformation of the tube plug at the transition from the cylindrical portion to the conical portion when the means for pulling out the tube plug are disposed in the conical portion. Moreover, as a result of the invention, scavenging, rinsing and flushing of the space between the heat exchanger tube and the conical portion of the plug is assured, thus preventing any concentration of corrosion products. The generation of strong mechanical stresses and therefore the danger of stress corrosion cracking are avoided during the firm rolling of the plug, because of the gentle transition from the cylindrical portion to the conical portion. The tube plug is manufactured from an austenitic steel, preferably Inconel.

In accordance with another feature of the invention, there is provided a film or coating of deformable metal being disposed at the roughened region. This is done in order to enable the tube plug to be pulled out without heating and to make the tube plug particularly easy to pull out.

In accordance with a further feature of the invention, the conical portion has a greater wall thickness than the cylindrical portion, and the positioning and locking means are in the form of a turned groove formed in the conical portion. This permits an adaptation of the tube plug to specialized pulling tools. Pulling tools can then be used that are simply introduced into the tube plug and locked, in order to assure strong pulling forces.

In accordance with an added feature of the invention, the turned groove is annular or is a thread.

In some cases it may be suitable if the turned groove is annular. This version of the tube plug makes it possible to use a simple pulling tool, which is provided with at least one spreadable barb. This permits simple, time-saving pulling of the tube plug, so that the exposure of operating personnel in the case of a nuclear reactor can be kept very low.

In accordance with an additional feature of the invention, the deformable metal is a nickel material. As a result, particularly high corrosion resistance and good deformability of the tube plug are attained, resulting in a particularly gas-tight and liquid-tight connection in heat exchanger tubes, which are usually made of Inconel.

In accordance with yet another feature of the invention, the cylindrical portion has an end with a flange, and the flange the cylindrical portion and the conical portion have a length to length ration of approximately 1:1.

With the objects of the invention in view there is also provided a method for loosening a tube plug firmly retained in a heat exchanger tube, particularly by expansion, which comprises introducing a welding tool into the interior of the predetermined path by melting the surface of the wall with the welding tool.

This overcomes the adhesion of the tube plug to the tube wall, so that the plug can be removed without major exertion of pulling force and without damaging the heat exchanger tube.

The tube plug is loosened particularly well if, in accordance with another mode of the invention, there is provided a method which comprises forming the welding path or seam along a meandering course.

In accordance with a further mode of the invention, there is provided a method which comprises subsequently removing the tube plug from the heat exchanger tube in a simple manner with the air of a pulling tool.

With the objects of the invention in view there is additionally provided a method for closing a defective heat exchanger tube, which comprises inserting a tube plug having a hollow cylindrical portion and a hollow conical portion into a heat exchanger tube, subsequently fastening the tube plug in the heat exchanger tube by expanding a cold-formed roughened region of the cylindrical portion from inside and forcing the roughened region into locking contact with the inner surface of the heat exchanger tube.

Other features which are considered as characteristic for the invention are set forth in the appended claims.

Although the invention is illustrated and described herein as embodied in a tube plug for closing a defective heat exchanger tube and a method for removing the tube plug, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages there of will be best understood form the following description of specific embodiments when read in connection with the accompanying drawings.

FIG. 1 is a fragmentary, diagrammatic, longitudinal-sectional view of a tube plug in a tube;

FIG. 2 is an enlarged, fragmentary, longitudinal-sectional view of a tube plug inserted into a heat exchanger tube and shrunk by means of a welding device.

FIG. 3 is a perspective developed view of a welding path of a molten inner surface of a tube plug;

Figure 4:
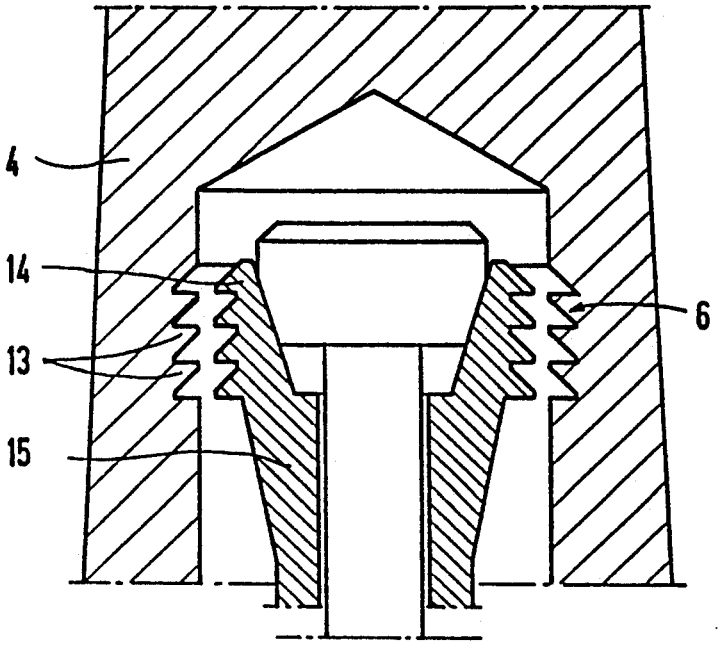
FIG. 4 is a fragmentary, longitudinal-sectional view of a tube plug having annular turned grooves, and an associated pulling tool.

Referring now to the figures of the drawings in detail and first, particularly, to FIG. 1 thereof, there is seen a tube plug 1, which is inserted into a defective heat exchanger tube 2 of a nuclear reactor. The tube plug 1 is formed of a hollow cylindrical segment or portion 3, which fluidly merges on the inside and outside with a conical segment or portion 4, without a step. The conical portion 4 is closed off at the end in a hemispherical shape. Prior to installation, the tube plug 1 has an outside diameter that is slightly smaller than the inside diameter of the heat exchanger tube 2 which has an end to be closed. The ratio in length between the cylindrical portion 3 and the conical portion 4 is approximately 1:1, and both portions are made of the same material, such as "Inconel". The tube plug 1 is brought into sealing contact with the inner surface of the heat exchanger tube 2 by expansion or rolling of a middle region 5 of the cylindrical portion 3, and as a result the tube plug is firmly retained in the heat exchanger tube 2. To this end, the tube plug 1 has a roughened surface with a peak-to-valley height of 0.05 to 0.2 mm in the region 5 to be expanded. The term "roughening" is understood to mean cold forming of the surface, such as by rolling, compressing, and/or by blasting with sand or glass. The roughening may be uniform or may be formed of irregular regions, the latter provision increasing the retaining forces. The roughened portion may be a plurality of grooves 3' formed in the outer surface of the portion 3, being concentric to the axis of the portion 3 and having a width being less than 1 mm.

In the closed end of the conical portion 4, means 6 are provided for positioning and locking a tool. The means 6 may alternatively be accommodated in the cylindrical portion 3. The tool may be a pulling tool or jigging tool, for example. The means 6 may, for example, be a thread. Further details of these features will be provided in conjunction with FIGS. 4 and 5.

The end of the cylindrical portion 3 of the tube plug 1 is provided with a flange 7, which has at least one notch 8 formed therein for torque-locking engagement of a charging, insertion or positioning tool. Thus on one hand a depth stop is provided upon insertion of the tube plug 1 into the heat exchanger tube 2, and on the other hand twisting of the tube plug during the expansion is prevented. The charging, insertion or positioning tool which engages the notch 8, securely retains the tube plug 1 in its position. Damage to the tube plug 1 or to the heat exchanger tube 2 is thus precluded.

After the insertion of the tube plug 1 into the heat exchanger tube 2, a non-illustrated rolling tool is introduced into the tube plug 1 and expands the tube plug 1 in the region 5, so that the tube plug 1 is firmly retained in the heat exchanger tube 2. Due to the gentle transition from the cylindrical portion 3 to the conical portion 4, the production of strong mechanical stresses and therefore the danger of stress cracking corrosion during the firm rolling of the tube plug 1, are avoided.

As FIG. 2 shows, the region 5 can also be provided with a coating or film 9 of deformable metal on the outside. This provides particularly good sealing action and also permits easy pulling of the tube plug 1.

A nickel material such as pure nickel or a nickel alloy is used an example of a deformable metal. This provides particularly strong corrosion resistance and good deformability of the region 5, resulting in a particularly tight connection in the heat exchanger tube 2, which is usually formed of Inconel.

In order to loosen the expanded tube plug 1 if necessary, the following method is employed, and is described in conjunction with FIG. 2: The tube plug 1 has a wall 11 which is melted on the inside, in particular at the expanded region 5 on the inside of the cylindrical portion 3, along a predetermined path **12*a* by welding with welding electrodes 12*b* of a welding tool 10 introduced into the interior of the tube plug 1. The predetermined path 12***a* may, for instance, be spiral. As a result of the melting, the expanded region 5 of the cylindrical portion 3 shrinks. In other words, it contracts in diameter, thereby overcoming the adhesion of the tube plug 1 to the tube wall 12. The tube plug 1 can then be removed without major exertion of pulling force and without damaging the heat exchanger tube 2.

Although no cleaning of the heat exchanger tube 2 is necessary prior to the installation, easier pulling of the tube plug 1 as compared with the prior art methods and devices is possible, while the retaining forces are increased and sealing action is improved. The wall thickness of the conical portion 4 is greater than that of the cylindrical portion 3. As a result, the disposition of the means 6 for pulling the tube plug 1 in the conical portion 4 does not cause any deformation of the tube plug 1 when it is pulled.

Furthermore, because of the shape of the tube plug 1, scavenging, rinsing or flushing of the space between the heat exchanger tube 2 and the conical portion 4 of the tube plug 1 after installation, is assured. This prevents a concentration of corrosion products.

FIG. 3 shows the cylindrical portion 3 of a cut-open tube plug 1, which has the path 12*a*, in this case a meandering path, on the inside thereof at the tube plug wall 11. The tube plug 1 becomes easily removable from the heat exchanger tube 2 by melting the tube plug 1 along such path 12*a*.

FIG. 4 is a cross section of a detail or portion toward the end of the conical portion 4 that is provided with the means 6 for positioning a pulling tool 15. In this case the means 6 is constructed as a number of turned grooves 13. The turned grooves 13 are annular in shape. Extensible claws 14 of the pulling tool 15 can be made to hook into the turned grooves 13. Such a pulling tool 15 can be positioned particularly quickly and simply. In a further method step, the tube plug 1 is removed from the heat exchanger tube 2 by means of the pulling tool 15. As a result, particularly short usage times are attained. This also keeps the exposure to operating personnel very low, if the heat exchanger is exposed to radiation.

Figure 5:
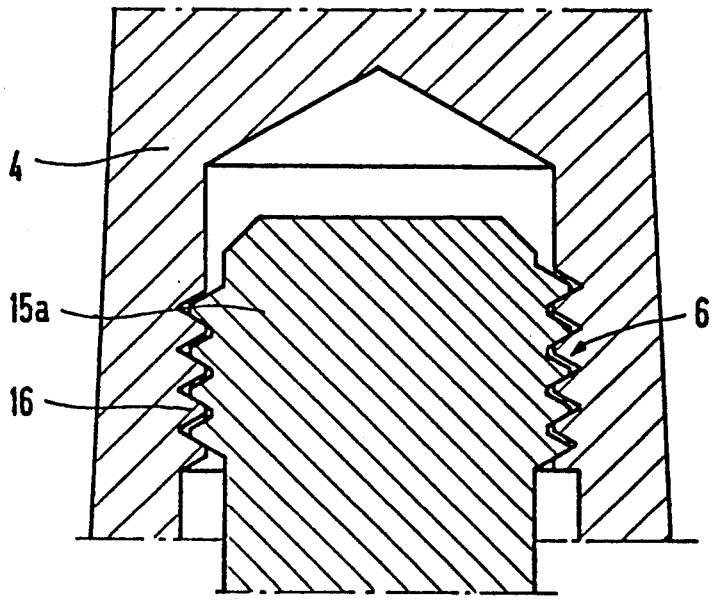
FIG. 5 is a view similar to FIG. 4 of a tube plug with a thread and with the associated pulling tool.

FIG. 5 shows a further embodiment of the tube plug 1, in which the means 6 is constructed as a thread 16. A pulling tool 15*a*, which in this case is helical at the end thereof, is locked in the tube plug 1 by a rotational motion.

We claim:

1. Tube plug for closing a defective heat exchanger tube, comprising a hollow conical portion having outer and inner surfaces and a closed free end, a hollow cylindrical portion having outer and inner surfaces merging smoothly with said outer and inner surfaces respectively of said hollow conical portion without an edge, said outer surface of said hollow cylindrical portion having an outside diameter being smaller than the inside diameter of the heat exchanger tube to be closed, said outer surface of said hollow cylindrical portion having a predeterminedly roughened region to be expanded into sealing contact with the inner surface of the heat exchanger tube, said roughened region having a peak-to-valley height of substantially between 0.05 and 0.2 mm, and means disposed in at least one of said portions for positioning and locking a pulling tool.

2. Tube plug according to claim 1, including a film of deformable metal being disposed around said roughened region.

3. Tube plug according to claim 2, wherein said deformable metal is a nickel material.

4. Tube plug according to claim 1, wherein said conical portion has a greater wall thickness than said cylindrical portion, and said positioning and locking means are in the form of a turned groove formed in said conical portion.

5. Tube plug according to claim 4, wherein said turned groove is annular.

6. Tube plug according to claim 4, wherein said turned groove is a thread.

7. Tube plug according tc claim 1, wherein said cylindrical portion has an end with a flange, and said flange has at least one notch formed therein for engagement by a tool.

8. Tube plug according to claim 1, wherein said cylindrical portion and said conical portion have approximately the same length.

9. Method for loosening a tube plug firmly retaining in a heat exchanger tube, which comprises the step of introducing a welding tool into the interior of the tube plug having a hollow conical portion with a closed free end, a hollow cylindrical portion merging smoothly with the hollow conical portion without an edge, the hollow cylindrical portion having an outer surface with a predeterminedly roughened region with a peak-to-valley height of substantially between 0.05 and 0.2 mm expanded into sealing contact with the inner surface of the heat exchanger tube, and the step of shrinking the wall of the tube plug along a predetermined path by melting the surface of the wall with the welding tool.

10. Method according to claim 9, which comprises melting the surface of the wall along the predetermined path.

11. Method according to claim 9, which comprises removing the tube plug from the heat exchanger tube with a pulling tool by positioning and locking the pulling tool to means provided in at least one of the portions and pulling after shrinking the wall of the tube plug.

12. Method for closing a defective heat exchanger tube, which comprises inserting a tube plug having a hollow cylindrical portion and a hollow conical portion into a heat exchanger tube, subsequently fastening the tube plug in the heat exchanger tube by expanding a cold-formed predeterminedly roughened region of the cylindrical portion form inside and forcing the roughened region into locking contact with the inner surface of the heat exchanger tube.

13. Tube plug for closing a defective heat exchanger tube, comprising a first portion having inner and outer surfaces, a cylindrical second portion having inner and outer surfaces smoothly merging respectively with said inner and outer surfaces of said first portion without an edge, said outer surface of said second portion having an outside diameter being smaller than the inside diameter of the heat exchanger tube to be closed, said outer surface of said second portion having a predeterminedly roughened region to be expanded into sealing contact with the inner surface of the heat exchanger tube, and means disposed in at least one of said portions for positioning and locking a pulling tool.

14. Tube plug according to claim 13, wherein said second portion is hollow.

15. Tube plug according to claim 13, wherein said second portion has a cylindrical axis, said roughened region is in the form of a plurality of annular grooves formed in said outer surface of said second portion concentrically relative to the cylindrical axis of said second portion, an said grooves have a width being less than 1 mm.

16. Tube plug according to claim 13, wherein said first portion has a longitudinal cavity formed therein.

* * * * *